US011591683B2

(12) United States Patent
Georges et al.

(10) Patent No.: US 11,591,683 B2
(45) Date of Patent: Feb. 28, 2023

(54) METHOD OF MANUFACTURING NICKEL BASED SUPER ALLOY PARTS

(71) Applicant: PRATT & WHITNEY CANADA CORP., Longueuil (CA)

(72) Inventors: Thomas Georges, Longueuil (CA); Orlando Scalzo, Boucherville (CA); Marc Lorenzo Campomanes, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 179 days.

(21) Appl. No.: 16/793,159

(22) Filed: Feb. 18, 2020

(65) Prior Publication Data

US 2021/0252594 A1 Aug. 19, 2021

(51) Int. Cl.

| | |
|---|---|
| ***C22F 1/10*** | (2006.01) |
| ***B22F 3/22*** | (2006.01) |
| ***C22C 1/04*** | (2006.01) |
| *B22F 5/04* | (2006.01) |
| *F01D 5/28* | (2006.01) |

(52) U.S. Cl.

CPC ..... *C22F 1/10* (2013.01); *B22F 3/225* (2013.01); *C22C 1/0433* (2013.01); *B22F 5/04* (2013.01); *F01D 5/286* (2013.01); *F05D 2300/175* (2013.01); *F05D 2300/609* (2013.01)

(58) Field of Classification Search

CPC ..... C22C 1/0433; C22C 1/023; C22C 45/04; C22F 1/10; B22F 3/225; B22F 5/04; B22F 2301/15; F01D 5/286; F05D 2300/175; F05D 2300/609

See application file for complete search history.

(56) References Cited

U.S. PATENT DOCUMENTS

| | | | | |
|---|---|---|---|---|
| 5,571,345 | A * | 11/1996 | Ganesh | B22F 3/24 148/556 |
| 2012/0282106 | A1* | 11/2012 | Goller | B22F 3/15 416/244 R |
| 2018/0298470 | A1 | 10/2018 | Suzuki et al. | |
| 2019/0201972 | A1 | 7/2019 | Cappuccini et al. | |
| 2019/0283138 | A1 | 9/2019 | Sheng et al. | |

FOREIGN PATENT DOCUMENTS

| | | |
|---|---|---|
| WO | 2018216514 | 11/2018 |

OTHER PUBLICATIONS

ASTM International "Standard Test Methods for Determining Average Grain Size" (Year: 2020).*

* cited by examiner

*Primary Examiner* — Anthony J Zimmer
*Assistant Examiner* — Dean Mazzola
(74) *Attorney, Agent, or Firm* — Norton Rose Fulbright Canada LLP

(57) ABSTRACT

There is provided a method of treating a nickel base super alloy (NiSa) article. First, the NiSa article having fine grains is obtained. The NiSa article has a uniform distribution of the fine grains and substantially uniform mechanical properties throughout. One or more regions within the NiSa article are mechanically deformed. Then, the NiSa article is heat treated to obtain coarse grains in the one or more regions, the coarse grains having a size that is larger than that of the fine grains of the NiSa article outside of the one or more regions.

14 Claims, 6 Drawing Sheets

No plastic deformation

2% plastic deformation 2.5% plastic deformation

3% plastic deformation

METHOD OF MANUFACTURING NICKEL BASED SUPER ALLOY PARTS

TECHNICAL FIELD

The present disclosure generally relates to articles of nickel based super alloys and methods of making same, specifically the articles have adaptive grain size.

BACKGROUND

Nickel based super alloys (NiSa) are corrosion resistant high-temperature alloys that are particularly useful in the aerospace industry. The machinability of NiSa has always been a challenge, however NiSa traditionally can only be cast in order to make aircraft and/or gas turbine engine parts. The resulting NiSa cast part has substantially uniform grain size distribution, and therefore substantially uniform mechanical properties across the part. When used to manufacture complex parts, the mechanical properties obtained after casting may not be optimal for the function of complex parts. Casting yields large coarse grain size because of the heat extraction limitations, which while providing good creep resistance is less optimal with respect to fatigue.

Powder bed fusion deposition by electron beam fusion (PBF-EB) is an alternative method, however it is not able to produce non-weldable alloy and thus it is difficult to locally control microstructure of the grains with PBF-EB.

Therefore, improvements are needed in the manufacture of NiSa parts.

SUMMARY

In a first aspect there is provided a method of treating a nickel base super alloy (NiSa) article, the method comprising i) obtaining the NiSa article having fine grains, the NiSa article having a uniform distribution of the fine grains and substantially uniform mechanical properties throughout;

ii) mechanically deforming one or more regions within NiSa article; and iii) heat treating the NiSa article to obtain coarse grains in the one or more regions, the coarse grains having a size that is larger than that of the fine grains of the NiSa article outside of the one or more regions.

In one embodiment of the first aspect, the fine grains are equiaxed. In another embodiment of the first aspect the coarse grains are elongated. In a further embodiment of the first aspect, mechanical deformation is performed by plastic deformation. The mechanical deformation may be at least one of tensile deformation, compression deformation, cold rolling, hydroforming, peening and bending. In yet a further embodiment of the first aspect, the coarse grains are larger than the fine grains by a factor of between 2 to 80.

In a second aspect, there is provided a method of manufacturing a nickel base super alloy (NiSa) article, comprising: i) molding the NiSa article by powder metallurgy, the NiSa article having a uniform distribution of fine grains; ii) mechanically deforming one or more regions of the NiSa article; and iii) heat treating the NiSa article to obtain coarse grains in the one or more regions, the coarse grains having a size that is larger than that of the fine grains of the NiSa article outside of the one or more regions.

In one embodiment of the second aspect, the fine grains are equiaxed. In another embodiment of the second aspect the coarse grains are elongated. In a further embodiment of the second aspect, mechanical deformation is performed by plastic deformation. The mechanical deformation may be at least one of tensile deformation, compression deformation, cold rolling, hydroforming, peening and bending. In yet a further embodiment of the second aspect, the coarse grains are larger than the fine grains by a factor of between 2 to 80.

In a third aspect, there is provided an aircraft part comprising a body composed of nickel base super alloy (NiSa), the body including one or more regions within the body having coarse grains of NiSa, the body having fine grains of NiSa outside of the one more regions, the coarse grains having a size that is larger than that of the fine grains.

In one embodiment of the third aspect, the fine grains are equiaxed. In another embodiment of the third aspect the coarse grains are elongated. In a further embodiment of the third aspect, the one or more regions having an increased resistance to creep relative to a remainder of the body outside of the one or more regions. In yet a further embodiment of the third aspect, the coarse grains are larger than the fine grains by a factor of between 2 to 80.

DETAILED DESCRIPTION

The term "nickel based super alloy" or "NiSa" as used herein is understood to be nickel alloy, which may include nickel, iron-nickel, and between 0 to 10 weight % of Al, Co, Cr, Ta, Ti, Mo and/or other refractory metals as alloying elements, in respectively concentrations that will be appreciated and understood by the person skilled in the art. The person skilled in the art will also understand that such nickel based super alloys may also have other constituents. Such NiSa are suitable for and configured to be used in high temperature environments (e.g. greater than 1000 degrees C.).

Powder injection molding (PIM) or metal injection molding (MIM) of nickel alloys allows for the manufacture of complex parts that may be otherwise difficult to manufacture using other manufacturing processes. The as-molded surface finish of a part obtained after PIM may not require any additional post-molding operations to achieve requirements and feature definition that is fine enough to match or exceed any casting method's capabilities.

However, NiSa alloys are more difficult to manufacture than nickel alloys and are traditionally cast to create aircraft parts that are subject to high temperatures such as turbine blades and vanes. The term "aircraft part" as used herein is understood to include parts which are used within aircraft engines, such as but not limited to gas turbine engines, as well as parts of the aircraft's airframe itself. NiSa alloys are particularly desirable in the hot sections of aircraft engines because they have good resistance to creep, oxidation, sulfidation, and hot corrosion, as well as having a good stress rupture strength. NiSa alloys, due to their chemical composition, are however difficult to weld unless an additive manufacturing method such as powder bed fusion (PBF) is used.

The present disclosure provides NiSa alloys with adaptive grain size, and methods of manufacturing same, that are particularly suited for aircraft applications such as the hot sections of an aircraft engine.

Figure 1:
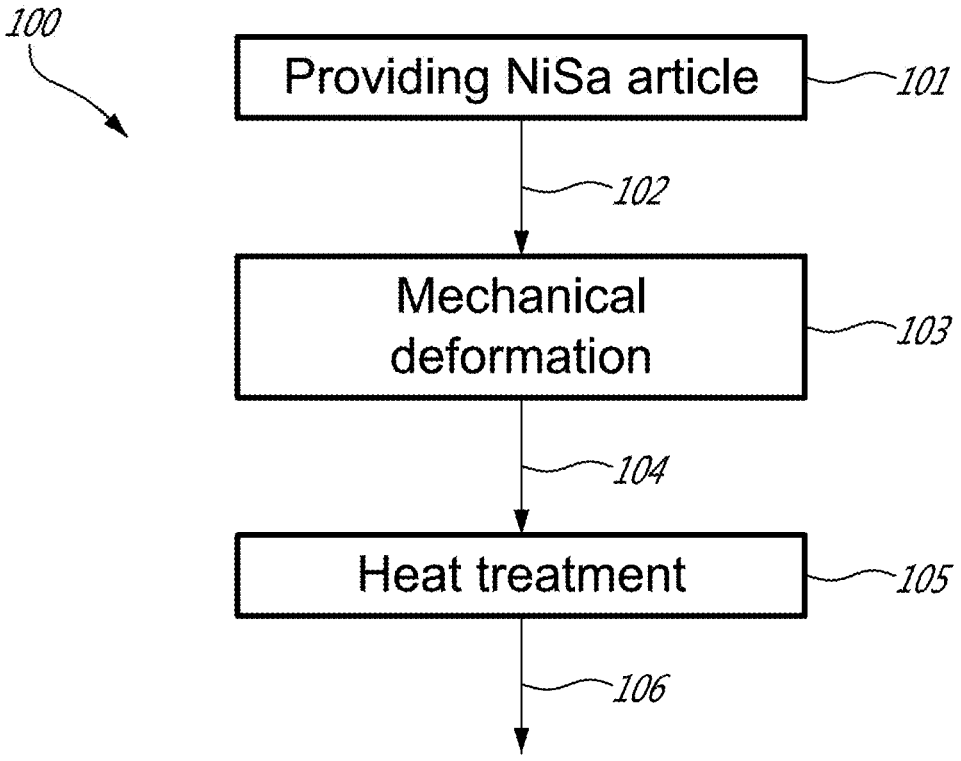
FIG. 1 is a schematic flow diagram of a method of tuning mechanical properties of a NiSa article according to an embodiment.

Referring to FIG. 1, in one embodiment there is provided a method 100 of tuning the mechanical properties of a NiSa article. The first step 101 is to provide a NiSa article 102 having fine grain size. The NiSa article 102 has, at this stage of the process, a uniform grain size distribution and substantially uniform mechanical properties. In one particular embodiment, the grains of the NiSa article 102 are equiaxed. In a particular embodiment, the NiSa article 102 may be manufactured by powder metallurgy such as PIM. The fine grain size that is uniformly distributed on the NiSa article 102 confers the NiSa article 102 with substantially uniform mechanical properties throughout the article. The NiSa article 102 has a high resistance to fatigue and low resistance to creep.

The next step 103 of the method 100 is to deform one or more regions of the NiSa article 102 by mechanical deformation 103, to obtain a deformed NiSa article 104. Mechanical deformation 103 may include any suitable deformation mechanism, such as plastic deformation. For example the mechanical deformation 103 may be one of tensile deformation, compression deformation, cold rolling, hydroforming, peening, spinning technics and bending. Other means for mechanically deforming the part may alternately be used. The one or more regions can be carefully chosen in order to optimize the overall mechanical properties of the final product NiSa article. For example, creep is more severe in conditions of high heat such as in the hot sections of an aircraft engine, and thus the desired regions of the article in the context of an aircraft engine could be the regions most exposed to the high heat conditions. These regions may include, for example, the exterior or peripheral regions of the part, and/or surfaces thereof that may be exposed during use to highest temperatures. After mechanical deformation 103, the deformed NiSa article 104 is subjected to a heat treatment 105. In one example, the heat treatment 105 is performed at a temperature between about 1000 and about 1200° C. for a duration of about 3 to about 5 hours. After the heat treatment 105, a NiSa article with adaptive grain size 106 is obtained.

The NiSa article 106 substantially retains the fine grains of the initial NiSa article 102 in the regions that were not subjected to mechanical deformation 103. The one or more regions that were subjected to mechanical deformation 103 will have coarse grains. The coarse grains have a size that is larger than the size of the fine grains. The coarse grains may be elongated. A coarse grain microstructure confers different mechanical properties to the one or more regions of the part. Coarse grains confer the one or more regions of the article an increased creep resistance and a decreased resistance to fatigue compared to the regions with fine grains. Therefore, it can be readily seen that a NiSa article can be tuned to have optimal mechanical properties through adaptive grain size microstructure. A NiSa part of an aircraft engine can be tuned to have coarse grains in the one or more regions that are most exposed to heat in order to increase the creep resistance thereby improving the overall performance of the part.

The deformation applied to a NiSa article can be controlled to precisely dictate the size of the coarse grains. The deformation can be a homogenous plastic deformation on one area. In further embodiments, the size of the coarse grains may be larger than the size of the fine grains by a factor of at least 2, 5, 20, 50 or 80.

Figure 2:
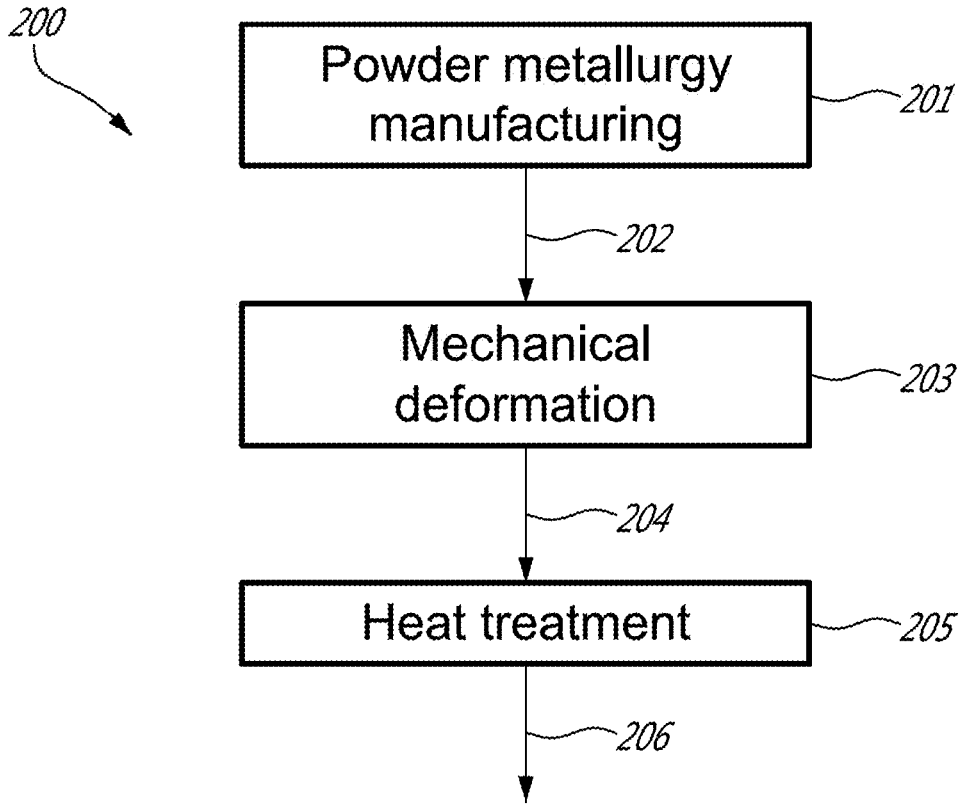
FIG. 2 is a schematic flow diagram of a method of manufacturing a NiSa article according to an embodiment.

Referring to FIG. 2, in one embodiment there is provided a method 200 of tuning the mechanical properties of a NiSa article. First, a NiSa article 202 is manufactured using powder metallurgy 201, for example PIM. Powder metallurgy may be performed as known to the person skilled in the art, for example by blending, compacting, and then sintering the powder. PIM or MIM may be used. For example, PIM may be performed by mixing the powder with a thermoplastic binder, then kneading, granulating, and injection moulding to obtain a "green" part. The major fraction of polymer binder is then removed to obtain a "brown" part. And finally, a sintering step is performed to obtain the final product. The NiSa article 202 has fine grains. The NiSa article 202 has a uniform grain size distribution and the grains of the NiSa article 202 may be equiaxed. The fine grain size that is uniformly distributed on the NiSa article 202 confers the NiSa article 202 uniform mechanical properties. The NiSa article 202 has a high resistance to fatigue and low resistance to creep. The next step is to deform one or more regions of the NiSa article 202 by mechanical deformation 203 to obtain a deformed NiSa article 204. Mechanical deformation 203 may be plastic deformation for example one of tensile deformation, compression deformation, cold rolling, hydroforming, peening and bending. The one or more regions can be carefully chosen in order to optimize the overall mechanical properties of the final product NiSa article. After, mechanical deformation 203 the deformed NiSa article 204 is subjected to a heat treatment 205. In one example, the heat treatment 205 is performed at a temperature between about 1000 and about 1200° C. for a duration of about 3 to about 5 hours.

After the heat treatment 205, a NiSa article with adaptive grain size 206 is obtained. The NiSa article 206 substantially retains the fine grains of the initial NiSa article 202 in the one or more regions that were not subjected to mechanical deformation 203. The regions that were subjected to mechanical deformation 203 will have coarse grains. The coarse grains have a size that is larger than the size of the fine grains. The coarse grains may be elongated. A coarse grain microstructure confers different mechanical properties to the one or more regions of the part. Coarse grains confer the regions of the article an increased creep resistance and a decreased resistance to fatigue compared to the regions with fine grains. Therefore, it can be readily seen that a NiSa article can be manufactured to have optimal mechanical properties through adaptive grain sizes. The grain size of the one or more deformed regions can be controlled by controlling the % of mechanical deformation applied. The larger the % of mechanical deformation applied the smaller the grain sizes will be compared to smaller % of mechanical deformation. The grain size of the mechanically deformed regions will still be superior to the untreated regions. In one example, at least 2%, at least 2.5%), or at least 3% mechanical deformation is applied on one or more regions of the NiSa article.

Figure 3:
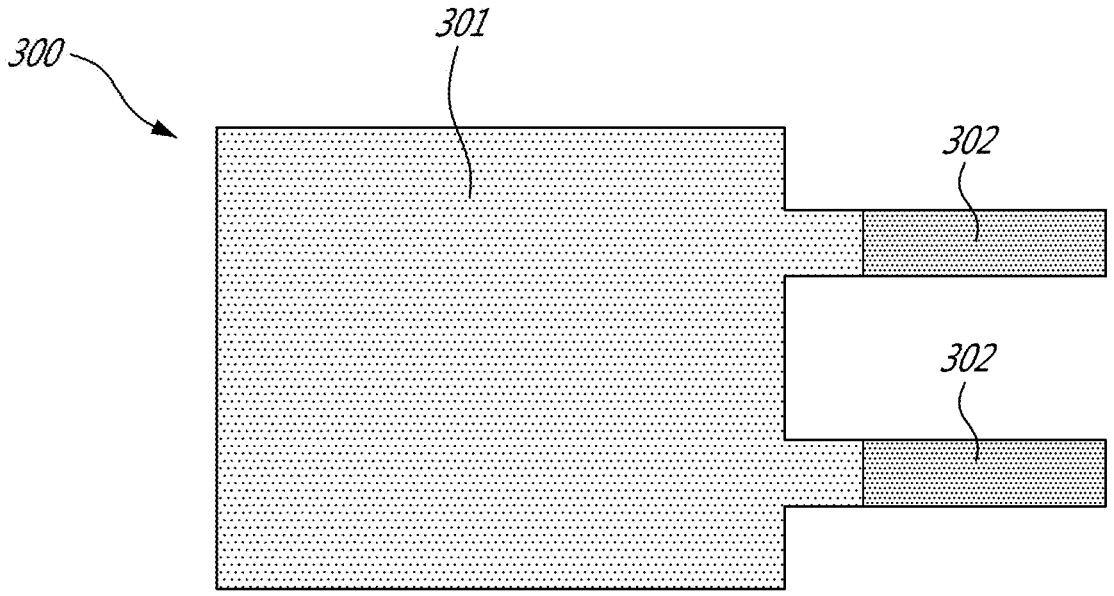
FIG. 3 is a schematic representation of a NiSa article according to an embodiment.
Figure 4:
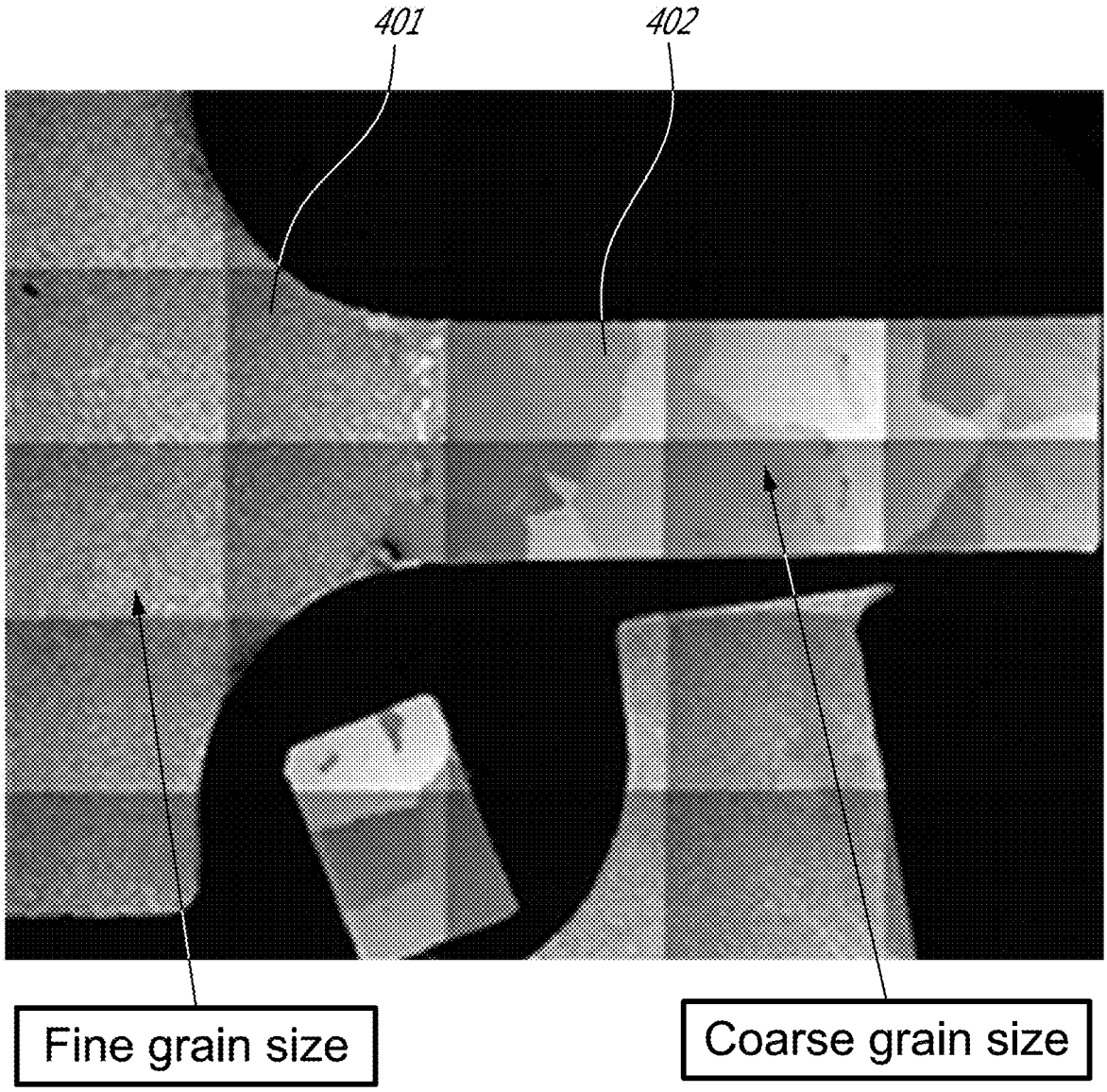
FIG. 4 is a microscopy image of a portion of a NiSa article according to an embodiment.

In one embodiment, there is provided an aircraft part 300 that is made of NiSa (FIG. 3) having adaptive grain size. In the finished part, once produced as described above, has one or more regions 301 with fine grains and one or more regions 302 with coarse grains. The coarse grains of the one or more regions 302 are larger than the fine grains of the one or more regions 301. As previously discussed, the fine grains may, in one particular embodiment, be equiaxed and the coarse grains may be elongated. In further embodiments, the size of the coarse grains may be larger than the size of the fine grains by a factor of at least 2, 5, 20, 50 or 80. FIG. 4 is a microscopy image of a portion of a NiSa article according to one embodiment that shows the fine grains region 401 and the coarse grains regions 402. Fine grains can be between about 25 and about 50 μm while coarse grains can be larger than about 500 μm.

Example I Manufacture of a NiSa Combustor Panel with Adaptive Grain Size

Figure 5A:
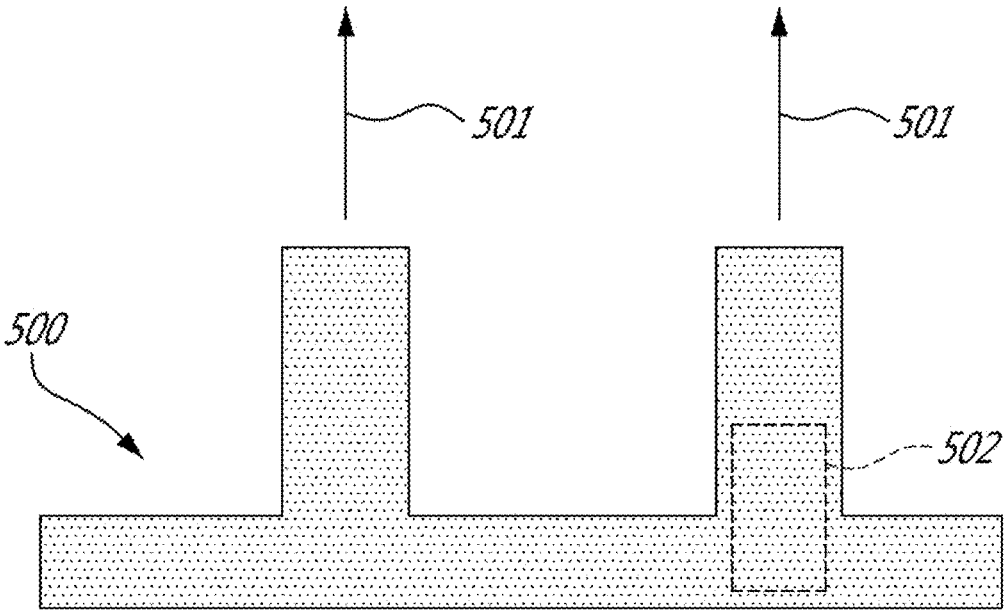
FIG. 5A is a schematic representation of an exemplary mechanical deformation of a NiSa article according to an embodiment.
Figure 5B:
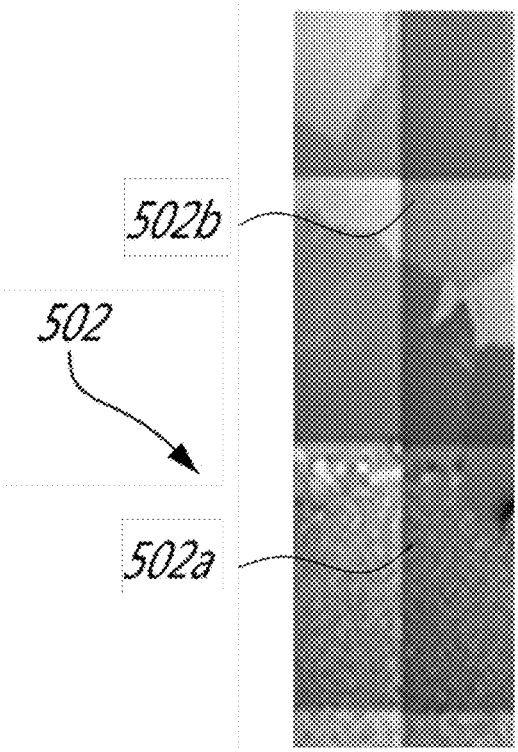
FIG. 5B is an exemplary microscopy image of a portion of the NiSa article obtained after the mechanical deformation of FIG. 5A.

In combustor panels creep mostly affects the stud. A simplified schematic of a part of a combustor panel 500 is provided in FIG. 5A. The combustor panel is made of NiSa and is manufactured by a PIM protocol as known in the art. Initially, the combustor panel has fine grains that are uniformly distributed and equiaxed. Then, a plastic deformation is applied to the combustor panel in the direction 501 as illustrated in FIG. 5A in order to deform the studs. The combustor is then subjected to a heat treatment. The heat treatment was performed at about 1100° C. for about 4 hours. After the heat treatment, the studs have coarse grains and therefore have an improved resistance to creep. To illustrate the adaptive grain size property of the combustor panel obtained, a region 502 is observed under the microscope. As can be seen in FIG. 5B two regions with distinct grain sizes and types are obtained, small fine grains in the region 502*a* and large coarse grains in the region 502*b* of the stud.

Example II Manufacture of a NiSa Compressor Blade with Adaptive Grain Size

Figure 6A:
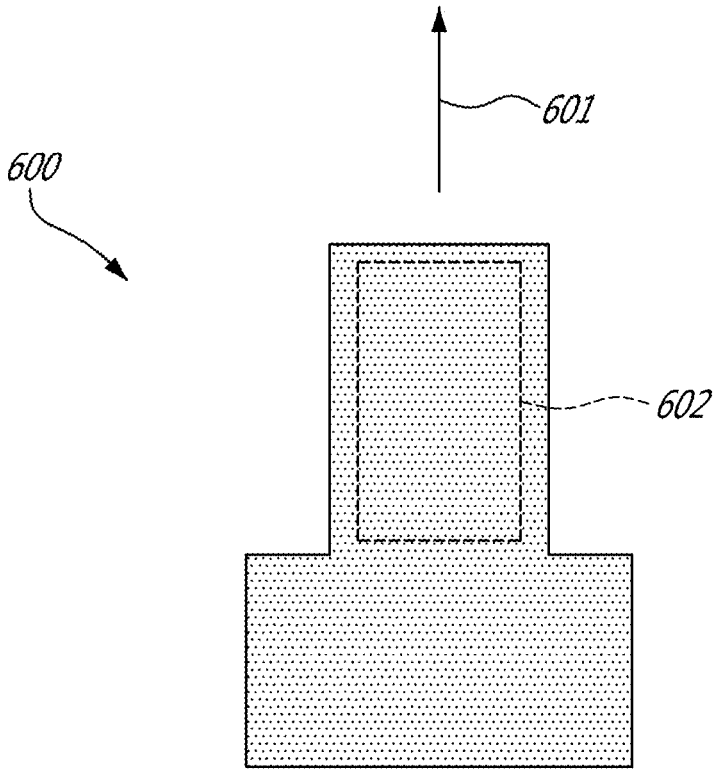
FIG. 6A is a schematic representation of an exemplary mechanical deformation of a NiSa article according to an embodiment.
Figure 6B:
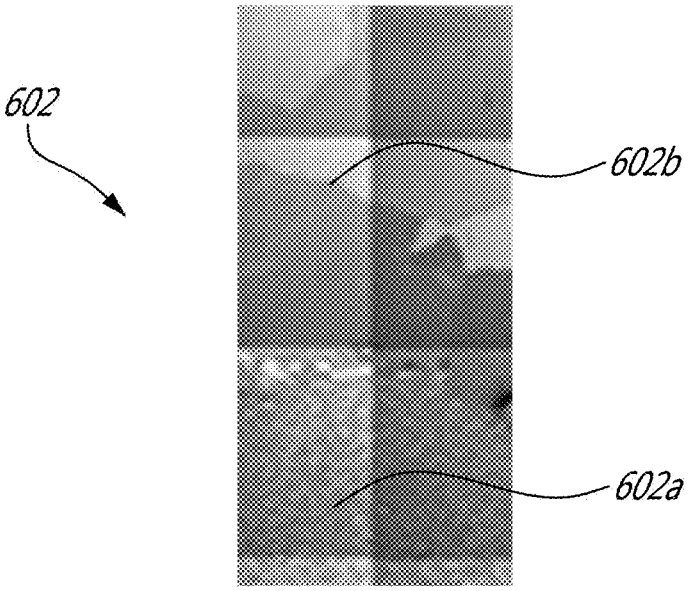
FIG. 6B is an exemplary microscopy image of a portion of the NiSa article obtained after the mechanical deformation of FIG. 6A.

In compressor blades, creep is most intense in the airfoil and fatigue is most intense at the fir tree. By manufacturing a blade with the method of the present disclosure, adaptive grain size allows the blade to have coarse grains at the airfoil to maximize creep resistance and fine grains at the fir tree to maximize the resistance to fatigue where it is needed. A simplified schematic of a blade 600 made of NiSa is shown in FIG. 6A. The blade is manufactured by PIM as performed by known protocols in the art. Initially, the blade has fine grains that are uniformly distributed and equiaxed. Then, a plastic deformation is applied to the blade in the direction 601 as illustrated in FIG. 6A in order to deform the airfoil. The blade is then subjected to a heat treatment at a temperature of about 1100° C. for about 4 hours. After the heat treatment, the airfoil will have coarse grains and therefore have an improved resistance to creep and the fir tree will maintain its resistance to fatigue by maintaining the fine grain microstructure. To illustrate the adaptive grain size property of the combustor panel obtained, a region 602 is observed under the microscope. As can be seen in FIG. 6B two regions with distinct grain sizes and types are obtained, small fine grains in the region 602*a* of the airfoil and large coarse grains in the region 602*b* of the fir tree.

Example III Effect of Different Percent of Mechanical Deformation

A NiSa article was manufactured by MIM as described by the present disclosure. Three different regions were subject to different intensities of plastic deformation summarized in Table 1.

TABLE 1

Results of three plastics deformations compared to the reference (ref) with no deformation

| Sample | Grain size | Creep life | Low cycle fatigue |
|---|---|---|---|
| NiSa as MIM (Ref) | 25 μm | At 1800° F. | Ref |
| NiSa + 2% plastic deformation | 1-2 mm | Similar to ref | No data |
| NiSa + 2.5% plastic deformation | 600 μm | No data | No data |
| NiSa + 3% plastic deformation | 500 μm | No data | No data |
| NiSa Cast material | 2-4 mm | 10x | 0.05x |

Figures 7A, 7B, 7C, 7D:
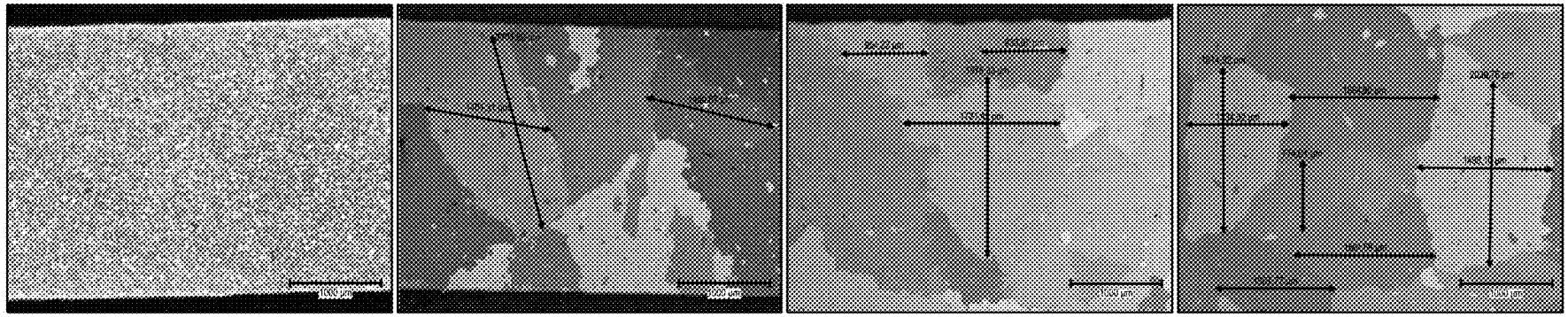
FIG. 7A is an exemplary microscopy image of a portion of a NiSa article, the scale bar represents 1000 μm.
FIG. 7B is an exemplary microscopy image of a portion of a NiSa article subjected to a 2% plastic deformation, the scale bar represents 1000 μm.
FIG. 7C is an exemplary microscopy image of a portion of a NiSa article subjected to a 2.5% plastic deformation, the scale bar represents 1000 μm.
FIG. 7D is an exemplary microscopy image of a portion of a NiSa article subjected to a 3% plastic deformation, the scale bar represents 1000 μm.

The grains of the NiSa region subjected to 2% plastic deformation had an increase in grain size of a factor between 40 to 80 compared to the non-deformed reference. The grains of the NiSa region subjected to 2.5% plastic deformation had an increase in grain size of a factor of 24 compared to the non-deformed reference. The grains of the NiSa region subjected to 3% plastic deformation had an increase in grain size of a factor of 20 compared to the non-deformed reference. The data for a NiSa cast material is shown for comparison. Microscopy images of the NiSa grains are shown in FIG. 7. FIG. 7A shows the reference NiSa as MIM with no plastic deformation, FIG. 7B shows the NiSa with 2% plastic deformation, FIG. 7C shows the NiSa with 2.5% plastic deformation, and FIG. 7D shows the NiSa with 3% plastic deformation.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A method of treating a nickel base super alloy (NiSa) article, the method comprising:

i) obtaining the NiSa article, the NiSa article having a uniform distribution of fine grains;

ii) mechanically deforming one or more regions within the NiSa article; and iii) heat treating the NiSa article to obtain coarse grains in the one or more regions, the coarse grains having a size that is larger than that of the fine grains of the NiSa article outside of the one or more regions, wherein the coarse grains are larger than 500 μm.

2. The method of claim 1, wherein the fine grains are equiaxed.

3. The method of claim 1, wherein the coarse grains are elongated.

4. The method of claim 1, wherein mechanically deforming includes a plastic deformation.

5. The method of claim 1, wherein mechanically deforming includes at least one of tensile deformation, compression deformation, cold rolling, hydroforming, peening and bending.

6. The method of claim 1, wherein the coarse grains are larger than the fine grains by a factor of between 2 to 80.

7. A method of manufacturing a nickel base super alloy (NiSa) article, comprising:

i) molding the NiSa article by powder metallurgy, the NiSa article having a uniform distribution of fine grains;

ii) mechanically deforming one or more regions of the NiSa article; and iii) heat treating the NiSa article to obtain coarse grains in the one or more regions, the coarse grains having a size that is larger than that of the fine grains of the NiSa article outside of the one or more regions, wherein the coarse grains are larger than 500 μm.

8. The method of claim 7, wherein the fine grains are equiaxed.

9. The method of claim 7, wherein the coarse grains are elongated.

10. The method of claim 7, wherein the one or more regions have at least an increased resistance to creep relative to a remainder of the NiSa article outside of the one or more regions.

11. The method of claim 7, wherein mechanically deforming includes a plastic deformation.

12. The method of claim 7, wherein mechanically deforming includes at least one of tensile deformation, compression deformation, cold rolling, hydroforming, peening and bending.

13. The method of claim 7, wherein molding the NiSa article is molded by powder injection molding.

14. The method of claim 7, wherein the coarse grains are larger than the fine grains by a factor of between 2 to 80.

* * * * *